United States Patent [19]

Tillgren

[11] 4,059,049

[45] Nov. 22, 1977

[54] METHOD AND A DEVICE FOR A BALE PRESS

[75] Inventor: Gunnar Kurt Arne Tillgren, Ystad, Sweden

[73] Assignee: Persöner Verkstad, AB, Ystad, Sweden

[21] Appl. No.: 687,482

[22] Filed: May 18, 1976

[30] Foreign Application Priority Data

May 28, 1975 Sweden ..... 7506082

[51] Int. Cl.[2] ..... B30B 15/14

[52] U.S. Cl. ..... 100/41; 100/3; 100/43; 100/50; 100/137; 100/256

[58] Field of Search ..... 100/2, 3, 191, 192, 100/43, 48, 50, 256, DIG. 8

[56] References Cited

U.S. PATENT DOCUMENTS

| | | | |
|---|---|---|---|
| 2,029,984 | 2/1936 | Buttfield | 100/192 X |
| 3,212,434 | 10/1965 | Raab | 100/43 |
| 3,350,999 | 11/1967 | Morse | 100/43 |
| 3,511,174 | 5/1970 | Raab | 100/43 |
| 3,587,448 | 6/1971 | Hemphill | 100/191 |

*Primary Examiner*—Billy J. Wilhite

*Attorney, Agent, or Firm*—Jones, Tullar & Cooper

[57] ABSTRACT

The invention pertains to an improved method and device for increasing the extent of compaction of materials having a tendency to reexpand when relieved after being compacted in a bale press. For being able to compensate for the reexpansion of the material compacted in a bale press when pushed forward through the press channel during compacting, it is suggested that the abutment, against which the material is compacted and which consists of the bale last produced, is tightened when the plunger of the bale press has reached a predetermined distance before its forward end position. This results in the desired maximum compaction being achieved when the plunger occupies its forward end position.

6 Claims, 2 Drawing Figures

METHOD AND A DEVICE FOR A BALE PRESS

Figure 1:
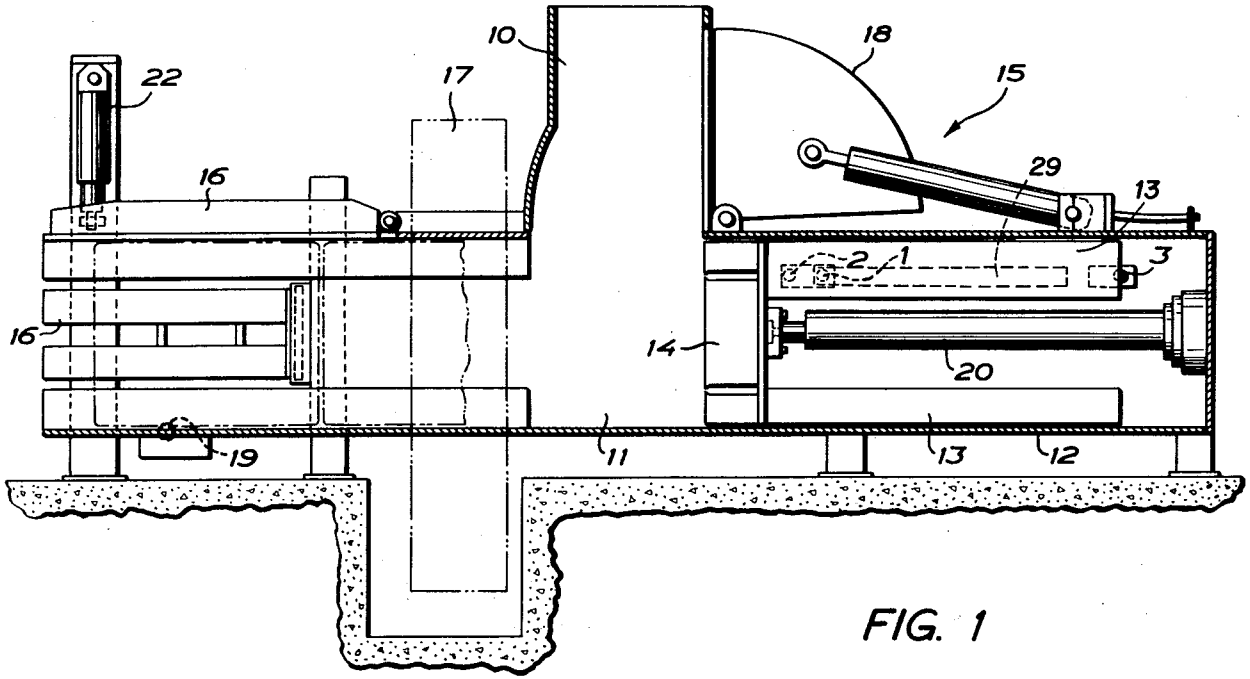

The present invention relates to a method and a device for bale presses for providing maximum compacting of material which has a tendency to reexpand more or less when relieved after being compacted.

In compacting loose material in a bale press the material in question is formed during at least one press duty cycle into a bale in a press channel by compaction between an abutment and a plunger and, in connection therewith, is pushed forward through the press channel. When a bale has been compacted to a predetermined length it is hooped by means of bands or wires and tied by means of a tying mechanism associated with the bale press, whereupon the rear surface of the bale thus formed will serve as an abutment in compacting material for the subsequent bale.

In compacting sheet metal and similar material which after being relieved maintains the shape obtained during the pressing there are no problems of reexpansion in connection with the compaction, but one or more press duty cycles may be performed until the bale has obtained the appropriate length for tying. However, in compacting for instance return paper or waste paper the compacted material expands on one hand when the plunger is returned at the end of a press duty cycle to its initial position for feeding new material into the bale press, and on the other hand when the compacted material is pushed through the pressing channel towards the discharge end thereof under the influence of a force exerted by the plunger means and exceeding the oppositely directed force exerted by the abutment. On account hereof one has had to accept an average density of the final bale, which is 5 to 10% below the one obtainable if the return paper does not reexpand after compaction.

An object of the invention is to provide a method and a device which eliminate these drawbacks and permit compensation for the reexpansion in bale presses when compacting material having a tendency to return to its original form when stresses are relieved.

This object is achieved by means of a method in pressing in a bale press material which after compacting tends to expand due to stored inherent resiliency when relieved from stresses, said material being compacted in a channel during application of equally large but opposite pressing forces from on one hand a movable plunger and on the other hand the rear surface of the bale last produced, said surface serving as an abutment, which last-produced bale is fixed in position by a tightening means until a predetermined pressing force has been obtained when the compacted material together with the bales ahead is displaced by a force exerted by the plunger, which force exceeds the force exerted on the material by the abutment, which method according to the invention distinguishes in that the abutment is fixed once more by further action of the tightening means when the plunger is located at a predetermined distance from its forward end position, whereby during the pushing forward of the material in question the reexpansion taking place therein is compensated for in the final movement of the plunger towards its forward end position.

For a better understanding of the invention the method according to the invention will now be described in detail with reference to an embodiment of the device according to the invention as shown in the accompanying drawings.

In the drawings

Figure 2:
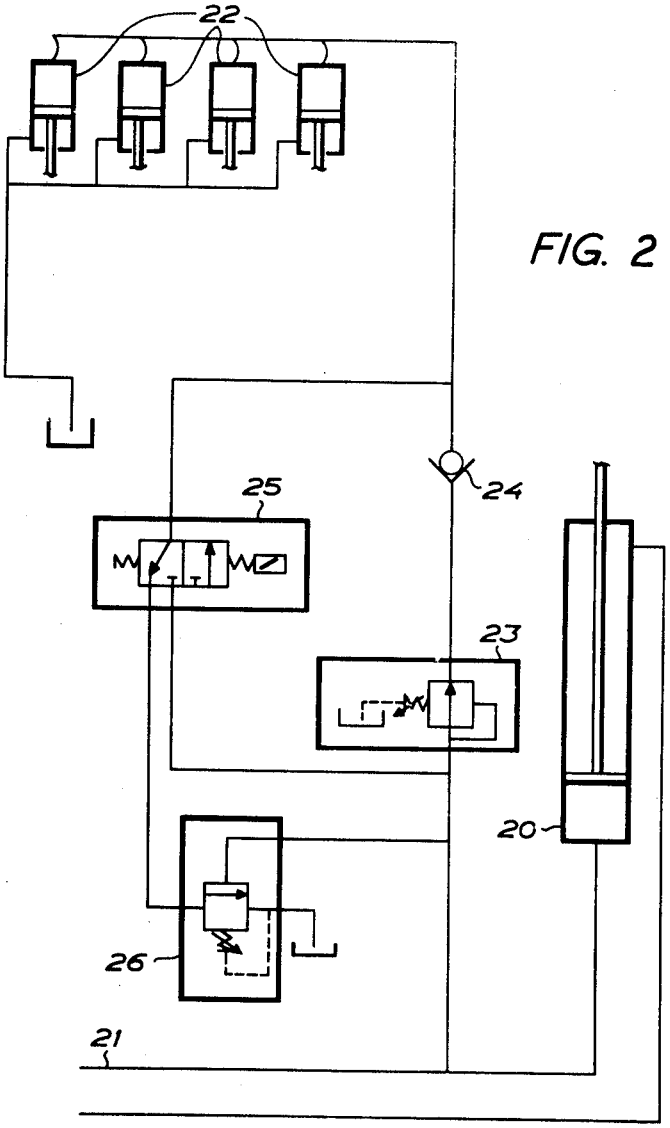

FIG. 1 is a longitudinal sectional view through a diagrammatically shown bale press, which is provided with a device for putting the method according to the invention into effect; and FIG. 2 illustrates a hydraulic circuit diagram including the essential elements of the device according to the invention.

Referring to FIGS. 1 and 2, the bale press illustrated therein, which is of the conventional horizontal type, comprises a vertical shaft or hopper 10 open upwards for supplying to the bale press the material, such as waste paper, to be compacted into bales. Shaft 10 communicates at the lower end thereof with a press channel 11 in the bale case 12. The channel 11, which extends in two opposite directions under the shaft 10, has a rectangular cross section. Pre-compacting means 15 is provided in connection with the shaft 10, which means consists of a hydraulically operated head 18, the side thereof facing the shaft closing the opening of the press channel 11 towards the shaft 10 when the head is brought to its extreme compacting position during pre-compaction.

A plunger 14 which is mounted on a carriage 13 and is shown in FIG. 1 in its initial or rear end position, is reciprocable in the channel 11 past the opening of shaft 10 by means of a hydraulic power cylinder 20 for compacting the material, pre-compacted in the space below the shaft 10, in the channel against an abutment which is constituted by the rear surface of the bale last produced, which surface faces the plunger. In FIG. 1 a complete bale and the forward portion of a bale being formed are shown in the press channel 11 by means of dotted lines. In order that the rear surface of the bale last produced may be able to serve as an abutment it must be possible to fix this bale and possibly the bales ahead in the pressed channel 11 in position. In order to achieve this a tightening means is provided at the discharge end of the press channel 11. The tightening means consists of flaps 16 mounted in the side walls and the upper wall of the case 12 and adapted to be pivoted about hinges towards the center of the press channel, said flaps being actuatable by means of hydraulic power cylinders 22 mounted in a yoke at the discharge end of the press channel 11. Only one of these hydraulic power cylinders 22 is shown in FIG. 1, viz. one of the two cylinders for actuation of the upper flap 16. The flaps 16, upon actuation to a position into the press channel 11 exert frictional forces against the bales in the press channel 11, whereby the bales are fixed in position during the press duty cycle.

When the plunger, by actuation of the power cylinder 20, is moved against the material in question for compacting it, the power cylinders of the flaps 16 are also actuated, the flaps thereby being pivoted towards the centre of the channel and securely fixing the bales located in the channel, so that the rear surface of the bale last produced maintains its position in the channel in a satisfactory manner. For hooping the material compacted into a bale, i.e. tying wires or bands around bales having a predetermined length, a tying mechanism 17 diagrammatically disclosed and a step wheel 19 coupled to a counter means are provided in the bale press. The step wheel 19 is mounted at the discharge end of the channel 11 for sensing the feeding forward of the bales and thus the displacement of the compacted material in the press channel 11 during the compacting operation, or the length of the compacted material. After a value preset thereon has been reached the counter means is adapted to supply a signal for actuation of the tying mechanism next time the plunger occupies its forward end position.

The tying mechanism 17, not being part of the invention, is not described here. It is sufficient to mention that during the tying operation, which can be done completely automatically, e.g. by means of the mechanism described in the U.S. Pat. No. 3,667,377, several wires are drawn around the bale in vertical planes parallel to the feed direction and are tied together. The tying mechanism 17 is stationary in the bale press and is adapted to be actuated when the plunger reaches its forward end position in which a substantially maximum press force is exerted on the compacted material.

A sensor 2 mounted on the side wall of the press channel 11 is adapted to supply a signal which indicates that the plunger 14 has reached its forward end position. Although the sensor 2 may be of any arbitrary kind and may be mounted in several different places for co-operation with the plunger 14 or the associated carriage 13, the sensor 2 illustrated in the bale press according to FIG. 1 comprises an inductive sensor which is provided for co-operation with the rear edge of the upper rear portion of the carriage 13. The inductive sensor 2 is positioned in the longitudinal direction of the channel 11, so that it is passed by the rear edge of the upper rear portion of the carriage 13 when the plunger has reached its forward end position, delivering a signal for actuation of the power cylinder 20 in the opposite sense for reversing the plunger to its starting position. Another sensor 3, which may also be of an arbitrary kind and may be mounted in a number of different places, but which consists of an inductive sensor in the embodiment of FIG. 1 and is mounted at the rear end of the channel 11 on substantially the same level as the sensor 2, is positioned in such a way that it will deliver a signal in cooperation with the rear edge of the upper rear portion of the carriage. This signal indicates that the plunger has been moved back past the opening to the shaft 10 and has occupied its starting position. This latter signal is utilized to indicate that a new press duty cycle can start.

At a predetermined distance behind the sensor 2, as viewed in the pressing direction, a further inductive sensor 1 is mounted on a level with the sensors 2 and 3 for cooperation with the same part of the carriage as the sensor 2. The sensor 1 is consequently adapted to deliver a signal which indicates that the plunger 14 has reached a predetermined position before its forward end position. This predetermined position is thus spaced the same distance from the forward end position of the plunger as the sensor 1 in relation to the sensor 2. The signal from the sensor 1 is utilized to actuate a control means in the hydraulic circuit for the actuation of the power cylinders 22 of the flaps 16 in connection with the compacting operation, in a way described in more detail below with reference to FIG. 2.

Of course, the sensor 1 may be of another kind than an inductive one and may be mounted for cooperation with an arbitrary part of the plunger or the press carriage 13 as long as it senses the predetermined position of the plunger before its forward end position.

The hydraulic circuit according to FIG. 2 illustrates the part of the hydraulic system of the bale press which is essential for the invention. The main cylinder 20 of the bale press is connected to one and the same supply conduit 21 for hydraulic liquid as the four power cylinders 22 for actuation of the flaps 16. The four power cylinders 22 for actuation of the flaps 16 are dimensioned in such a way in relation to the power cylinders 20 of the plunger 14 that when one and the same pressure acts on the power cylinders 22 and the power cylinder 20, they act on the flaps 16 in such a way that these exert a frictional force on the bale or bales clamped between said flaps, which force is as great as or greater than the pressing force exerted by the plunger 11, the abutment thereby being kept stationary. In the connecting conduit between the power cylinders 22 of the flaps 16 and the supply conduit 21 a sequence valve 23 lockable at a predetermined pressure, in this case $170 \times 10^5 N/m^2$, and a non-return valve 24 are inserted. The sequence valve 23 is adapted when the pressure at its input side reaches a predetermined value, to maintain this pressure at its output side also when the input pressure exceeds said predetermined pressure value.

At their low pressure ends the hydraulic cylinders 22 are connected to a vessel for free return flow of the hydraulic liquid. A direction valve 25 controllable by the sensor 1 is connected as a by-pass around the sequence valve 23 and the non-return valve 24. In the position shown in FIG. 2, which prevails at the start of the press duty cycle, the direction valve 25 connects the conduit between the hydraulic cylinders 22 of the flaps 16 and the non-return valve 24 with a relief valve 26 actuatable at the predetermined maximum pressure of the press, in this case $210 \times 10^5 N/m^2$. In its second position the direction valve 25 permits a by-pass around the sequence valve 23 and the non-return valve 24, the relief valve 26 being disengaged.

For a more detailed explanation of the method of the invention a press duty cycle is described below by means of the bale press according to FIG. 1, which press is provided with a device according to the invention, a material having a tendency to expand after compacting, e.g. waste paper, being utilized.

When the sensor 3 has indicated that the plunger 14 has been moved past the opening in the shaft 10, new material is filled into the shaft 10 up to a predetermined level. The pre-press 15 is then put into operation and presses the material down into the channel 11, the head 18 closing the opening towards the shaft 10. The power cylinder 20 of the plunger and the power cylinders 22 of the flaps are then subjected to the same pressure, whereby the plunger 14 is forced against the material in question and the flaps are pivoted inwardly towards the bales in the channel for blocking the same and fixing the position of the rear surface of the bale last produced serving as an abutment. The material compacted is exposed during this operation to equally great but oppositely directed forces from the plunger 14 and the abutment, respectively. When the pressure of the hydraulic liquid in the supply conduit 21 reaches the predetermined pressure value prescribed for the sequence valve 23 this valve is actuated, whereby when the pressure increases in the power cylinder 20 of the plunger the pressure in the power cylinders 22 of the flaps is maintained constant. Since the pressing force from the plunger 14 increases while the frictional force exerted by the flaps 16 on the bales in the press channel 11 is kept constant at such a level that the plunger may exert a maximum pressure without the abutment moving, the material being compacted will be compacted to its maximum. This is due to the construction of the tightening means, which is constituted in such a way that the friction forces acting on the bales clamped in the channel and therefore acting on the abutment will well compensate the maximum pressing force from the plunger even if the pressure of the power cylinders of the tightening means is maintained at the pressure value prescribed for the sequence valve 23. When maximum pressure has been reached the relief valve 26 is actuated, the application of flaps 16 against the abutment ceasing and the material compacted being displaced towards the discharge end of the channel under the action of the plunger. This displacement is simultaneously sensed by means of the step wheel 19 at the discharge end of the channel and is summed up in the counter means.

Since there is a pressure difference over the compacted material between that side where the plunger acts, and the abutment, the material in question will expand during its movement owing to its inherent resiliency.

When the upper rear edge of the press carriage 13 passes the sensor 1, i.e. when the plunger 14 reaches the predetermined position before its forward end position, this sensor will, however, activate the direction valve 25, which is then switched into its other position, the sequence valve 23 being by-passed and the relief valve 26 being blocked. Owing to the non-return valve 24 connected in series with the sequence valve 26 the same pressure is then applied to the power cylinders 22 of the flaps as to the power cylinder 20 of the plunger. This results in the bales in the channel 11 being fixed once more and the material in question being compacted against a substantially firm abutment, whereby the expansion of the material during its displacement is compensated for during the final movement of the plunger forward to its front end position. If upon actuation of the sensor 2 the counter means associated with the step wheel 19 has reached the predetermined value the tying mechanism is put into operation for hooping and tying the bale thus formed, while the plunger 14 is maintained in its forward end position. When the tying operation is completed or if the counter means has not reached its predetermined value, the plunger is reversed, the valve 25 is switched to its first position, and the sequence valve 23 and the relief valve 26 are released for a new press duty cycle, which can start when the sensor 3 indicates that the plunger has occupied its rear end position, i.e. the starting position.

If the compacted material was not hooped and tied when the plunger 14 was in its forward end position, no pressing force will act upon the material compacted during that time interval from which the plunger is moved back to its starting position until new material fed into the bale press has begun to be compaced by the plunger, whereby the compacted material expands in the longitudinal direction of the channel, owing to the resiliency stored in the material in question. However, this expansion is compensated for in the subsequent press duty cycle.

As previously stated, the sensor 1 is stationary in order to sense that the plunger is at a predetermined distance before its front end position.

This predetermined distance is dependent on the tendency of the compacted material to reexpand when relieved after compacting and substantially corresponds to the distance which the compacted material would expand during its displacement in the channel if the apparatus according to the invention were not used. Since the material intended for compacting may have a varying tendency to reexpand after compacting, the sensor is arranged in such a way that it can be displaced in the longitudinal direction of the channel 11 to be securely locked at a distance behind the sensor 2 proper for the material in question. The sensor 2 is longitudinally adjustable in position as shown in FIG. 1, as the sensor may be positioned in slit or longitudinal aperature 24 and secured by conventional securing means.

The method according to the invention results in a particularly good effect in compacting such material as has a tendency to return to its initial shape when relieved after compacting. Thus, by means of the method according to the invention the density of bales produced from waste paper can be increased by as much as approximately 10% in comparison with density values previously obtained, resulting in a considerable saving of space in connection with the storing and transport of said bales.

As mentioned above, it is to be preferred that upon the displacement of the bales the flaps are caused to fix the bales securely in the final stage of the displacement sequence, not only during the press duty cycle when the hooping and tying is performed but in each press duty cycle. This results in the largest possible recovery of the reexpansion in the compacted material. Of course, however, the invention comprises the method that said fixing of the bales by means of the flaps is performed only in that press duty cycle when the hooping and tying is performed, as well as all modifications suggested by a person skilled in the art within the scope of the following claims.

What I claim is:

1. In a method in pressing in a bale press material which after compacting tends to expand due to stored inherent resiliency when relieved from stresses, said material being compacted in a channel during application of equally large but opposite pressing forces from on one hand a movable plunger means and on the other hand the rear surface of the bale last produced, said surface serving as an abutment, which last-produced bale is fixed in position by a tightening means until a predetermined pressing force has been obtained when the compacted material together with the bales ahead is displaced by a force exerted by said plunger means, which force exceeds the force exerted on the material by said abutment, the improvement comprising fixing the abutment once more by further action of said tightening means when said plunger means is located at a predetermined distance from its forward end position, the reexpansion taking place in said material during the pushing forward of the material being compensated for in the final movement of said plunger means towards its forward end position.

2. The method as claimed in claim 1, comprising achieving said further actuation of said tightening means by a sensor means which senses that the plunger means has reached the predetermined distance from its forward end position.

3. In combination with a bale press having a press channel having a movable plunger means therein to compact a material charged into the channel against the rear surface of a previously compacted bale serving as an abutment, said press channel being further provided with tightening means adapted to fix said previously compacted bale in a position in said channel until a predetermined press force is applied by said plunger means, and a first control means operably associated with said plunger means to signal an actuation system to release said tightening means, when said predetermined press force is applied, to permit a displacement of said compacted material towards the discharge end of said press channel, a device for compensating for reexpansion of said compacted material which tends to expand after compacting when relieved of stresses due to stored inherent resiliency, said device comprising a sensor means adapted to sense when said plunger means reaches a position a predetermined distance before its forward end position, and a second control means, responsive to the actuation of said sensor means, being arranged to further actuation of said tightening means for repeated fixing of the position of said abutment, said reexpansion taking place in said compacted material during said displacement of said compacted material being compensated for in the final movement of said plunger means towards its forward end position.

4. The device as claimed in claim 3, wherein a third control means which is operably associated with said actuation system of said tightening means, is connected in parallel with said second control means, said third control means providing for the first actuation of said tightening means for fixing the position of said abutment.

5. The device as claimed in claim 3, wherein said second control means consists of a direction valve which upon actuation of said sensor means is adapted to provide for by-pass coupling of said third control means and blocking of said first control means.

6. The device as claimed in claim 3, wherein said sensor means is adjustable in the longitudinal direction of said channel.

* * * * *